US011459789B2

(12) United States Patent
Thomas

(10) Patent No.: US 11,459,789 B2
(45) Date of Patent: Oct. 4, 2022

(54) HAMMOCK AND TENT ASSEMBLY

(71) Applicant: Keenan Thomas, Desoto, TX (US)

(72) Inventor: Keenan Thomas, Desoto, TX (US)

( * ) Notice: Subject to any disclaimer, the term of this patent is extended or adjusted under 35 U.S.C. 154(b) by 0 days.

(21) Appl. No.: 17/170,344

(22) Filed: Feb. 8, 2021

(65) Prior Publication Data

US 2022/0251869 A1 Aug. 11, 2022

(51) Int. Cl.

| | |
|---|---|
| ***E04H 15/32*** | (2006.01) |
| ***E04H 15/48*** | (2006.01) |
| ***A45F 3/24*** | (2006.01) |
| ***E04H 15/54*** | (2006.01) |
| ***E04H 15/58*** | (2006.01) |
| ***E04H 15/02*** | (2006.01) |

(52) U.S. Cl.
CPC ..... *E04H 15/324* (2013.01); *A45F 3/24* (2013.01); *E04H 15/02* (2013.01); *E04H 15/48* (2013.01); *E04H 15/54* (2013.01); *E04H 15/58* (2013.01)

(58) Field of Classification Search
CPC ..... E04H 15/324; A45F 3/24
See application file for complete search history.

(56) References Cited

U.S. PATENT DOCUMENTS

| | | | | |
|---|---|---|---|---|
| 142,327 A * | 9/1873 | Craft | A47C 3/0255 5/129 |
| 594,598 A | 11/1897 | Byxbe | |
| 851,927 A * | 4/1907 | Fyfe | A45F 3/24 135/96 |
| 1,343,800 A | 6/1920 | Trimm | |
| 4,236,543 A | 12/1980 | Moss | |
| 4,858,635 A | 8/1989 | Eppenbach | |
| 4,951,332 A * | 8/1990 | Barmettler | A45F 3/24 5/120 |
| 4,958,391 A * | 9/1990 | Egeland | A47C 17/84 5/414 |
| 5,240,021 A * | 8/1993 | Snodgrass | E04H 15/425 5/127 |
| D689,157 S | 9/2013 | Lucero | |
| 9,359,786 B1 | 6/2016 | Fenton | |
| 9,788,639 B2 * | 10/2017 | Frazer | E04H 15/324 |

(Continued)

FOREIGN PATENT DOCUMENTS

| | | | |
|---|---|---|---|
| CN | 101832056 A * | 9/2010 | E04H 15/48 |
| FR | 1150445 A * | 1/1958 | |

(Continued)

*Primary Examiner* — David R Dunn
*Assistant Examiner* — Danielle Jackson

(57) ABSTRACT

A hammock and tent assembly for viewing the sky includes a frame, a shell, and a hammock. The frame comprises a plurality of segments, which are hingedly interconnected so that the frame is selectively positionable in a deployed configuration and a stowed configuration. In the deployed configuration, the frame is substantially cuboid shaped and defines an interior space. In the stowed configuration, the segments are proximally positioned. The hammock is selectively engageable to the frame so that the hammock is suspended therefrom and positioned in the interior space. The shell is selectively positionable over and around the frame and can shelter a user positioned on the hammock. At least a portion of the shell positioned over the top is substantially transparent, thereby allowing the user a view therethrough.

12 Claims, 6 Drawing Sheets

(56) References Cited

U.S. PATENT DOCUMENTS

| | | | | |
|---|---|---|---|---|
| 10,858,819 | B2 * | 12/2020 | Styrc | E04B 1/1912 |
| 11,214,954 | B2 * | 1/2022 | Styrc | A45F 3/24 |
| 2005/0188460 | A1 * | 9/2005 | O'Brien | E04H 15/04 5/120 |
| 2007/0151589 | A1 | 7/2007 | Holub | |
| 2012/0152293 | A1 | 6/2012 | Lucero | |
| 2018/0305950 | A1 | 10/2018 | Siebenaler | |
| 2019/0048613 | A1 * | 2/2019 | Bierwolf | E04H 15/40 |

FOREIGN PATENT DOCUMENTS

| | | | | |
|---|---|---|---|---|
| GB | 2284621 | A * | 6/1995 | E04H 15/48 |
| GB | 2411667 | | 9/2005 | |
| KR | 101543363 | B1 * | 8/2015 | |
| WO | WO-2009092227 | A1 * | 7/2009 | E04H 15/48 |

* cited by examiner

HAMMOCK AND TENT ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to tent assemblies and more particularly pertains to a new tent assembly for viewing the sky. Disclosed herein is a tent assembly comprising a foldable frame, which supports a hammock. A portion of a shell, which is selectively positionable over the frame so that the portion is positioned on a top of the frame, is substantially transparent to allow for a view therethrough.

(2) Description of Related Art Including Information Disclosed Under 37 CFR 1.97 and 1.98

The prior art relates to tent assemblies. Prior art tent assemblies may comprise foldable frames for tents and hammocks, tents having shelves integral thereto, tree supported tent and hammock combinations, tents with screened viewing ports in tops thereof, and tents having at least one substantially transparent roof section. What is lacking in the prior art is comprising a foldable frame, which supports a hammock. A portion of a shell, which is selectively positionable over the frame so that the portion is positioned on a top of the frame, is substantially transparent to allow for a view therethrough.

BRIEF SUMMARY OF THE INVENTION

An embodiment of the disclosure meets the needs presented above by generally comprising a frame, a shell, and a hammock. The frame comprises a plurality of segments, which are hingedly interconnected so that the frame is selectively positionable in a deployed configuration and a stowed configuration. In the deployed configuration, the frame is substantially cuboid shaped and defines an interior space. In the stowed configuration, the segments are proximally positioned. The hammock is selectively engageable to the frame so that the hammock is suspended therefrom and positioned in the interior space. The shell is selectively positionable over and around the frame and thus is configured to shelter a user positioned on the hammock. At least a portion of the shell positioned over the top is substantially transparent and thus configured to allow the user a view therethrough.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
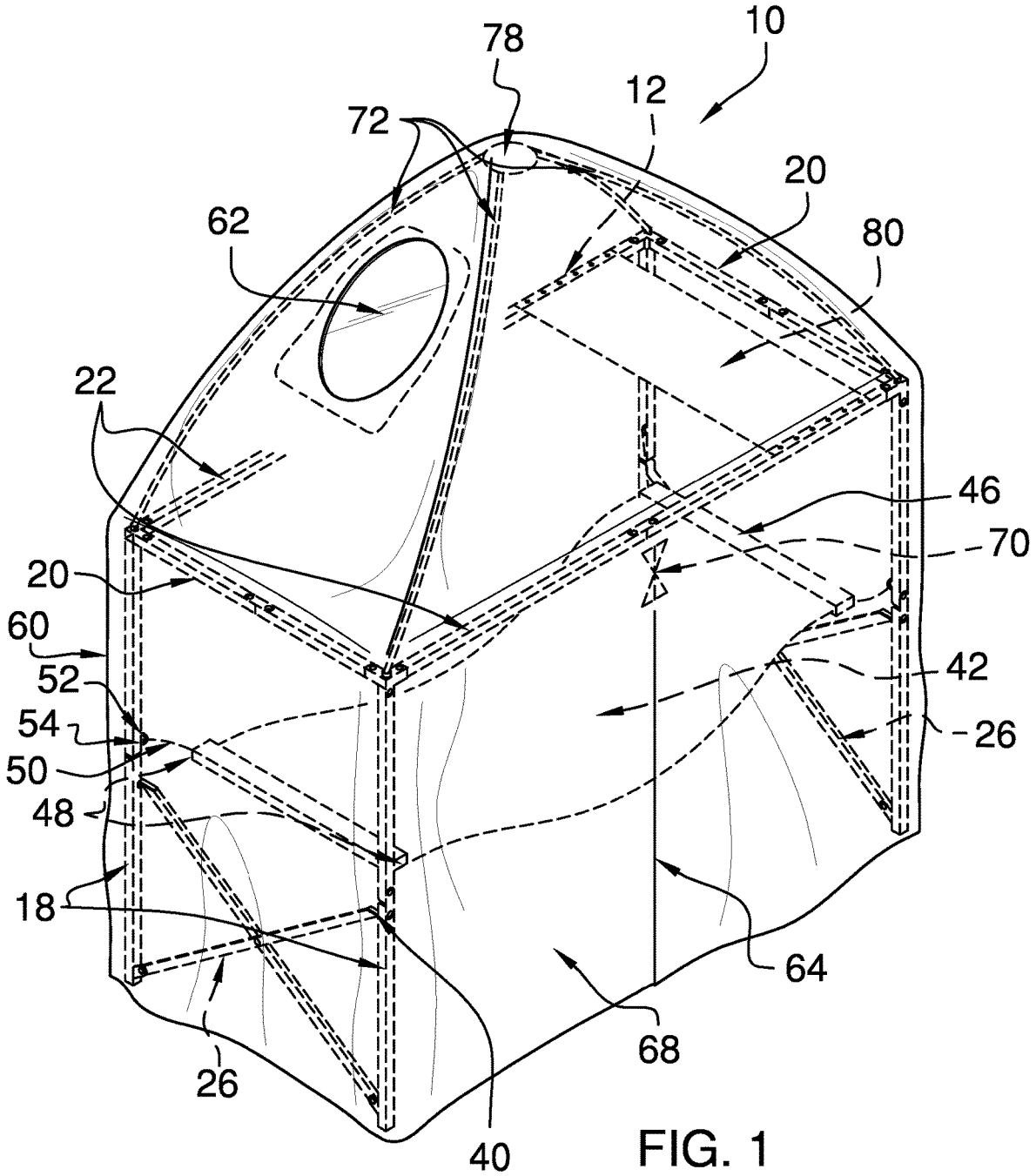
FIG. 1 is an isometric perspective view of a hammock and tent assembly according to an embodiment of the disclosure.

With reference now to the drawings, and in particular to FIGS. 1 through 6 thereof, a new tent assembly embodying the principles and concepts of an embodiment of the disclosure and generally designated by the reference numeral 10 will be described.

As best illustrated in FIGS. 1 through 6, the hammock and tent assembly 10 generally comprises a frame 12, which comprises a plurality of segments 14. The segments 14 are hingedly interconnected so that the frame 12 is selectively positionable in a deployed configuration and a stowed configuration. In the deployed configuration, as shown in FIG. 1, the frame 12 is substantially cuboid shaped and defines an interior space 16. In the stowed configuration, the segments 14 are proximally positioned.

Figure 2:
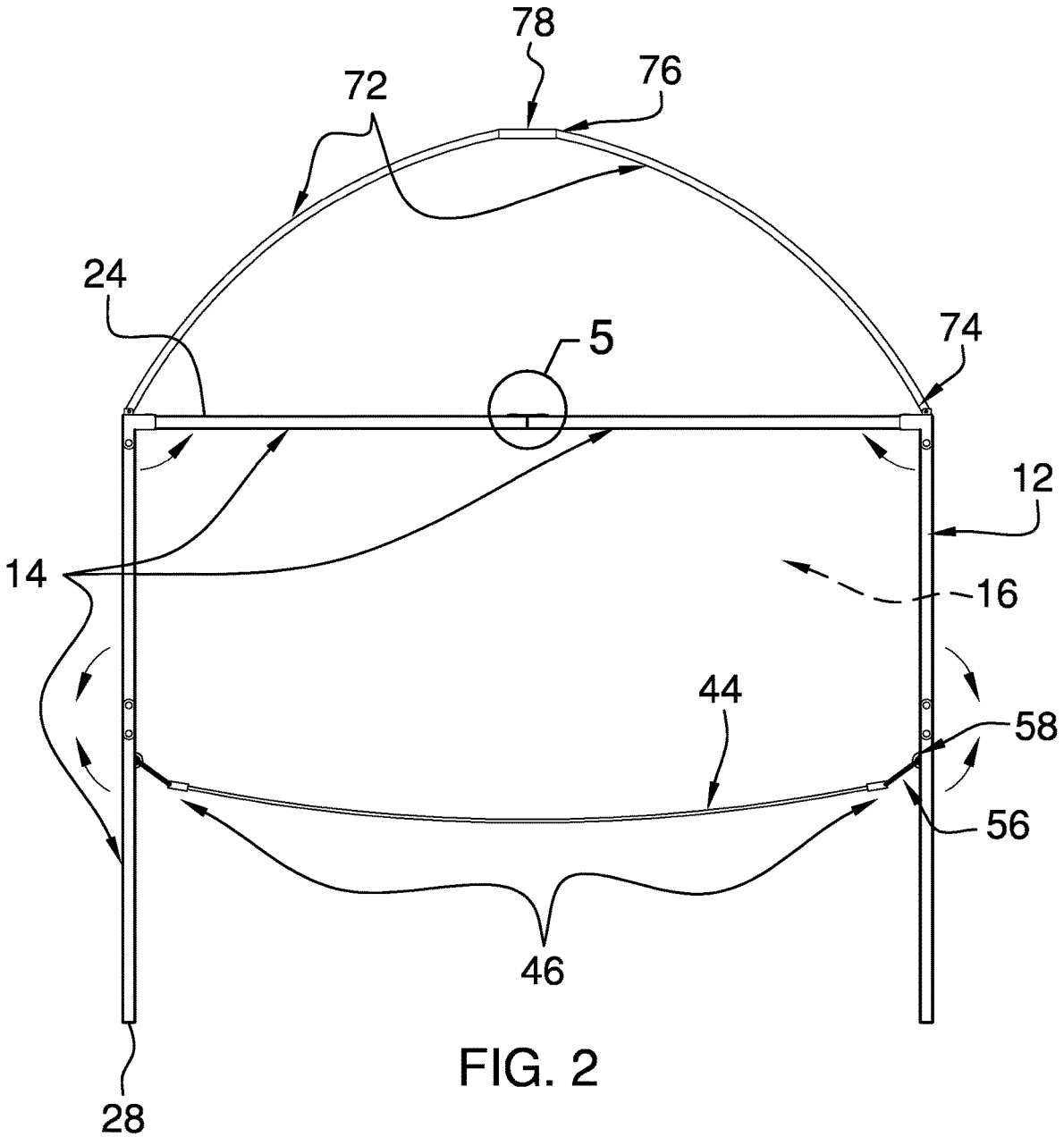
FIG. 2 is a front view of an embodiment of the disclosure.
Figure 3:
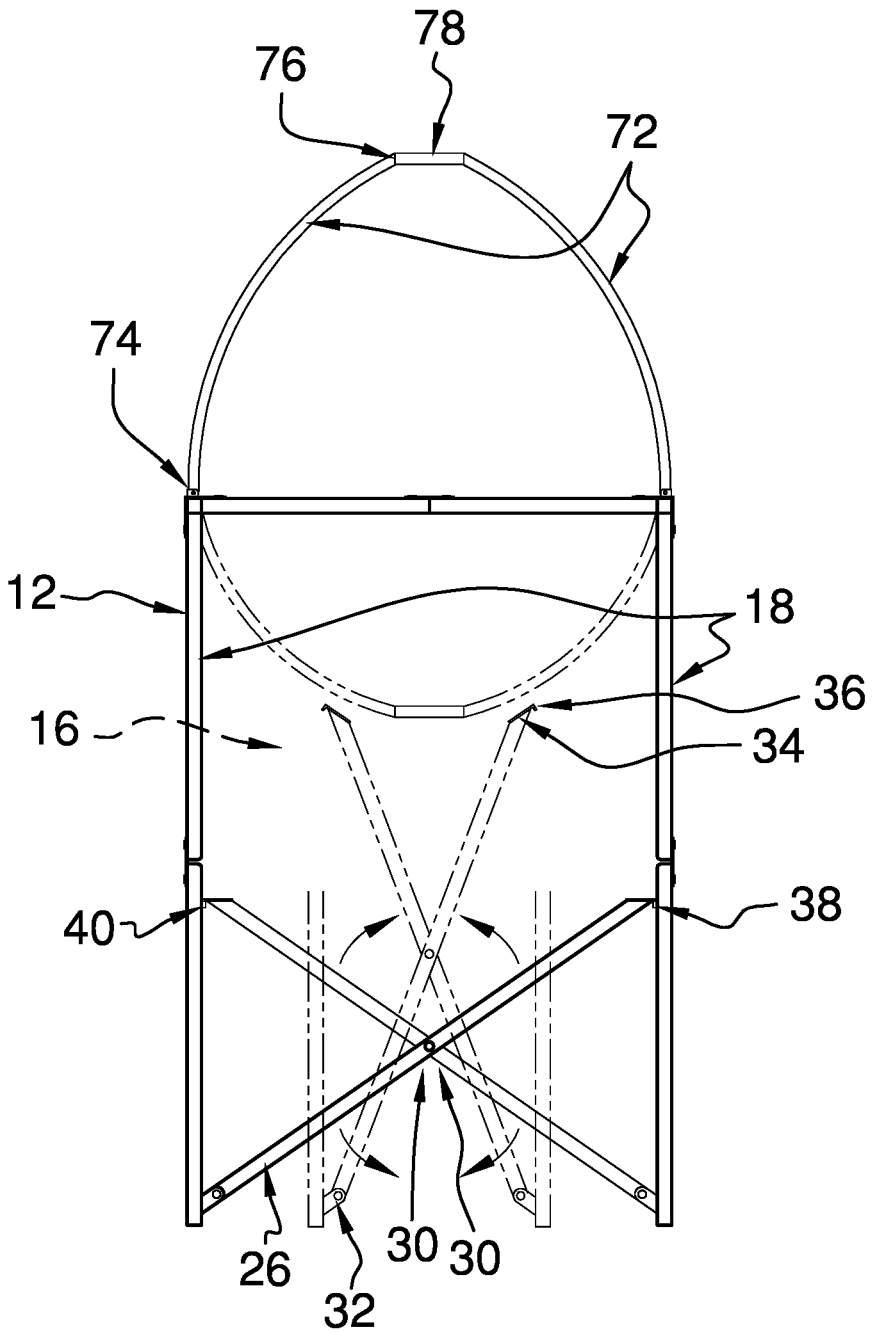
FIG. 3 is a side view of an embodiment of the disclosure.
Figure 4:
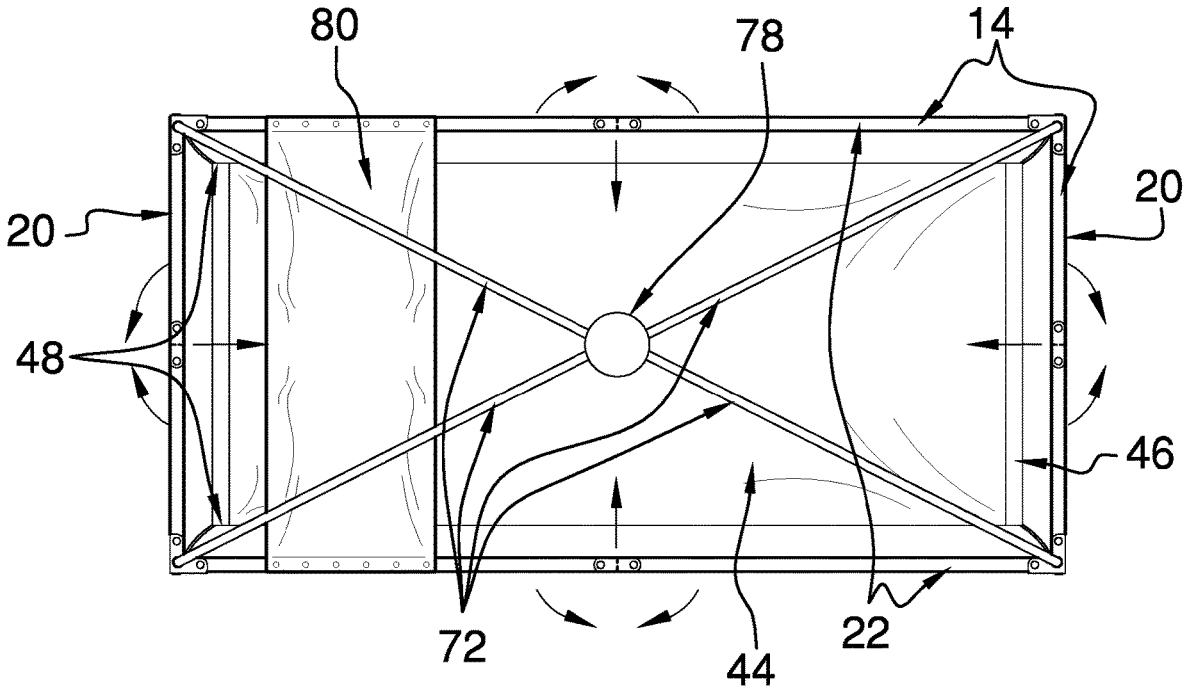
FIG. 4 is a top view of an embodiment of the disclosure.
Figure 5:
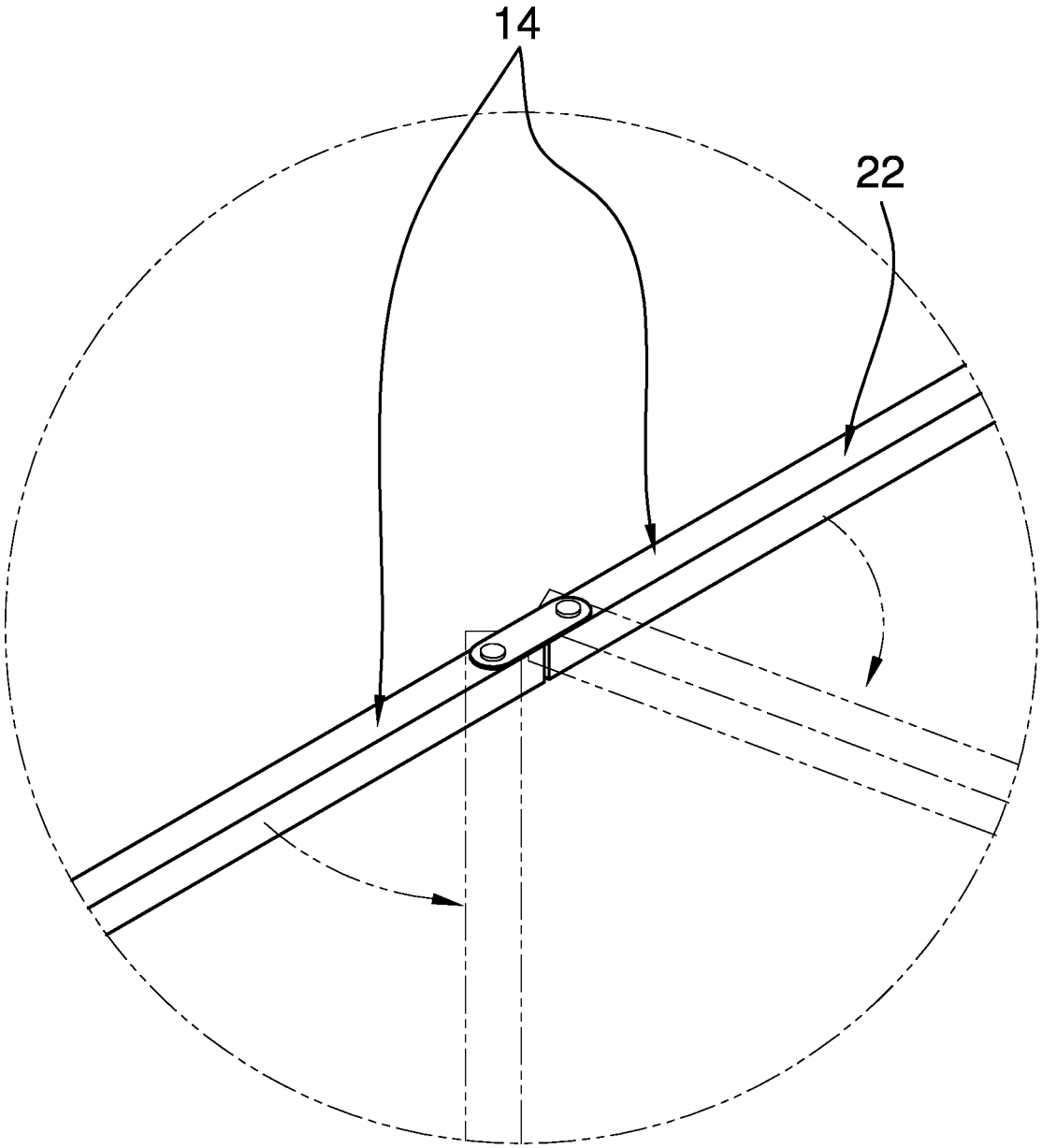
FIG. 5 is a detail view of an embodiment of the disclosure.
Figure 6:
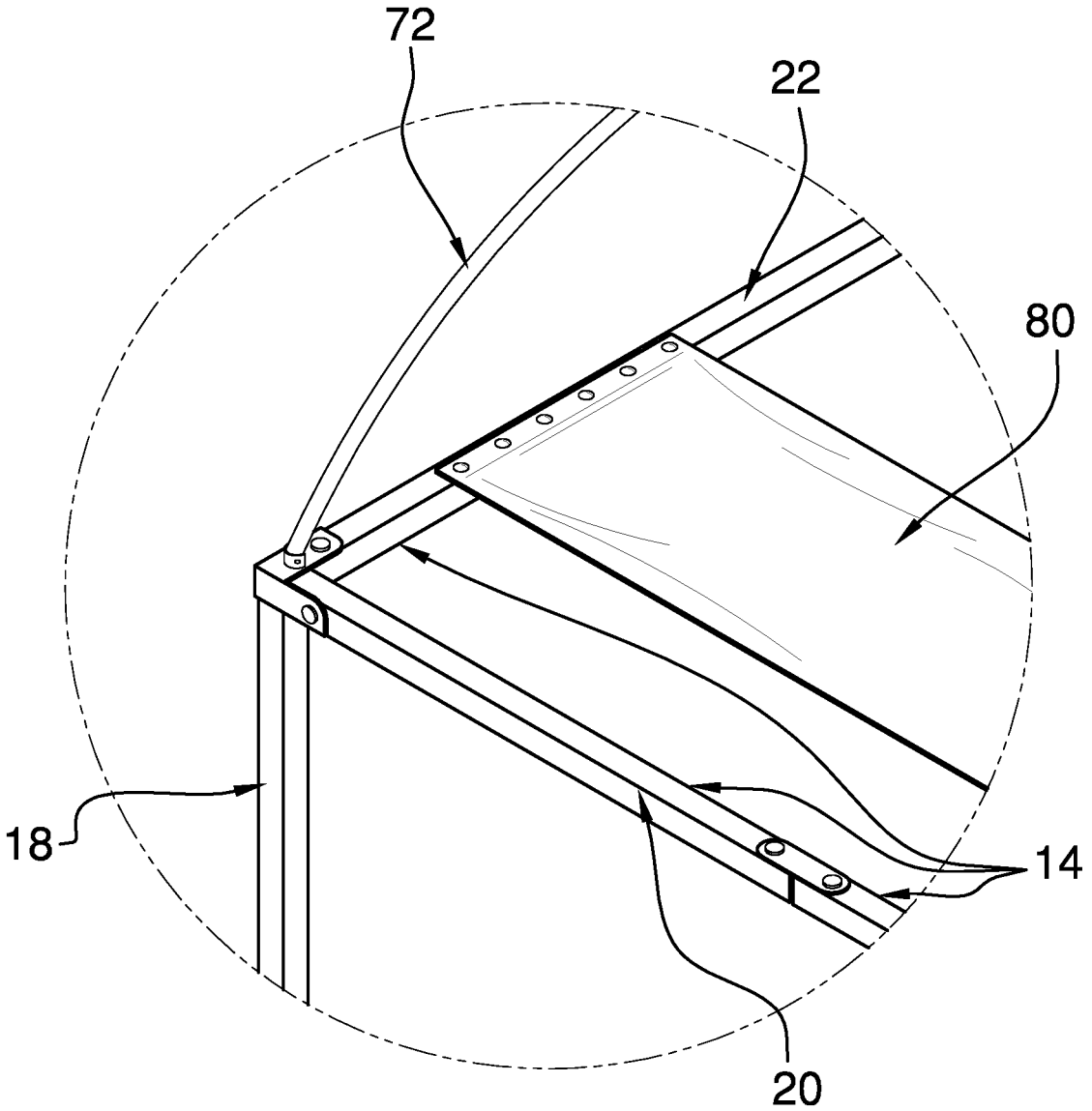
FIG. 6 is a detail view of an embodiment of the disclosure.

The plurality of segments 14 comprises a set of posts 18, a pair of end rails 20, and a pair of side rails 22. Each end rail 20 is hingedly engaged to and extends between adjacently positioned posts 18 so that the end rails 20 are opposingly positioned across a top 24 of the frame 12. Each side rail 22 is hingedly engaged to and extends between adjacently positioned posts 18 so that the side rails 22 are opposingly positioned across the top 24 of the frame 12. Each of the posts 18, each of the end rails 20, and each of the side rails 22 comprises two segments 14, as shown in FIGS. 2-4.

The frame 12 also may comprise a pair of crossbeams 26. Each crossbeam 26 is positioned below a respective end rail 20 and is engaged to and extends between adjacently positioned posts 18 proximate to a bottom 28 of the frame 12. The crossbeam 26 comprises two segments 14, which are rotationally engaged proximate to midpoints 30 thereof. Each segment 14 has a lower end 32 hingedly engaged to a respective one of the adjacently positioned posts 18. The segment 14 has an upper end 34 selectively engageable to the other of the adjacently positioned posts 18 so that the crossbeam 26 is X-shaped, as shown in FIG. 1. The crossbeam 26 is positioned to stabilize the adjacently positioned posts 18 substantially in parallel.

The upper end 34 of the segment 14 of the crossbeam 26 has a first fastener 36 engaged thereto. The first fastener 36 is positioned to selectively engage a second fastener 38, which is engaged to the other of the adjacently positioned posts 18, so that the segment 14 is removably engaged to the other of the adjacently positioned posts 18. The first fastener 36 and the second fastener 38 may comprise a latch closure 40, or other fastening means, such as, but not limited to, bolts, pin locks, and the like.

A hammock 42 is selectively engageable to the frame 12 so that the hammock 42 is suspended therefrom and positioned in the interior space 16. The hammock 42 comprises a sling panel 44, which is engaged to and extends between a pair of beams 46. Each beam 46 has opposed ends 48, each of which is selectively engageable to a respective post 18. As shown in FIG. 2, the opposed end 48 has a line 50 extending therefrom. The line 50 has a first coupler 52 engaged thereto. The first coupler 52 is positioned to selectively engage a second coupler 54, which is engaged to the respective post 18. The line 50 thus is removably engaged to the post 18. The first coupler 52 may comprise a carabiner 56 and the second coupler 54 may comprise an eyebolt 58.

A shell 60 is selectively positionable over and around the frame 12 and thus is configured to shelter a user positioned on the hammock 42. At least a portion 62 of the shell 60, which is positioned over the top 24, is substantially transparent and thus configured to allow the user a view therethrough.

The shell 60 has a slit 64 positioned in a wall 68 thereof. The slit 64 is configured for entry of the user into the interior space 16. A closure is engaged to the wall 68 proximate to the slit 64. The closure is positioned to selectively close the slit 64. The closure may comprise a zipper 70, as shown in FIG. 1, or other closing means, such as, but not limited to, hook and loop fasteners, snap closures, and the like.

Each of a plurality of rods 72 is hingedly engaged by a first endpoint 74 to the top 24 of the frame 12 and extends therefrom. Each rod 72 has a second endpoint 76, which is hingedly engaged to a hub 78 so that the hub 78 is hingedly engaged to each rod 72 of the set of rods 72. The rods 72 are resiliently flexible so that the set of rods 72 is selectively positionable in a deployed position and a stowed position, as shown in FIG. 3. In the deployed position, the rods 72 extend upwardly from the top 24 of the frame 12 and the shell 60 is domed. The stowed position corresponds to the stowed configuration of the frame 12.

A shelf panel 80 is engaged to and extends between the side rails 22 proximate to a respective end rail 20. The shelf panel 80 comprises fabric, elastomer, or the like, so that the shelf panel 80 is flexible. The shelf panel 80 is positioned to fold as the frame 12 is motivated into the stowed configuration. The shelf panel 80 extends substantially planarly between the side rails 22 with the frame 12 in the deployed configuration and thus is configured to have an article position thereupon.

In use, the frame 12 is transported to a selected location then motivated from the stowed configuration to the deployed configuration. The hammock 42 then is attached to the posts 18 and the shell 60 is positioned over the frame 12 and the rods 72. The user can enter the shell 60 by opening and passing through the slit 64. An overhead view is available to the user through the portion 62 of the shell 60 that is substantially transparent.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A hammock and tent assembly comprising:

a frame comprising a plurality of segments, the segments being hingedly interconnected such that the frame is selectively positionable in a deployed configuration, wherein the frame is substantially cuboid shaped and defines an interior space, and a stowed configuration, wherein the segments are proximally positioned;

a hammock selectively engageable to the frame such that the hammock is suspended therefrom and positioned in the interior space;

a shell selectively positionable over and around the frame, wherein the shell is configured for sheltering a user positioned on the hammock, at least a portion of the shell positioned over the top being substantially transparent, wherein the portion is configured for allowing the user a view therethrough; and a plurality of rods, each rod being hingedly engaged by a first endpoint to a top of the frame and extending therefrom, each rod having a second endpoint hingedly engaged to a hub, such that the hub is hingedly engaged to each rod of the set of rods, the rods being resiliently flexible, such that the set of rods is selectively positionable in a deployed position, wherein the rods extend upwardly from the top of the frame, such that the shell is domed, and a stowed position corresponding to the stowed configuration of the frame.

2. The hammock and tent assembly of claim 1, wherein the plurality of segments comprises:

a set of posts;

a pair of end rails, each end rail being hingedly engaged to and extending between adjacently positioned posts, such that the end rails are opposingly positioned across a top of the frame; and a pair of side rails, each side rail being hingedly engaged to and extending between adjacently positioned posts, such that the side rails are opposingly positioned across the top of the frame.

3. The hammock and tent assembly of claim 2, wherein:

each post comprises two segments;

each end rail comprises two segments; and each side rail comprises two segments.

4. The hammock and tent assembly of claim 2, wherein the frame comprises a pair of crossbeams, each crossbeam being positioned below a respective end rail and being engaged to and extending between adjacently positioned posts proximate to a bottom of the frame.

5. The hammock and tent assembly of claim 4, wherein each crossbeam comprises two segments, the segments being rotationally engaged proximate to midpoints thereof, each segment having a lower end hingedly engaged to a respective one of the adjacently positioned posts, ea segment having an upper end selectively engageable to the other of the adjacently positioned posts, such that each crossbeam is X-shaped and positioned for stabilizing the adjacently positioned posts substantially in parallel.

6. The hammock and tent assembly of claim 5, further including the upper end of each segment having a first fastener engaged thereto, such that the first fastener is positioned for selectively engaging a second fastener engaged to the other of the adjacently positioned posts, such that each segment is removably engaged to the other of the adjacently positioned posts.

7. The hammock and tent assembly of claim 6, wherein the first fastener and the second fastener comprise a latch closure.

8. The hammock and tent assembly of claim 2, wherein the hammock comprises a sling panel engaged to and extending between a pair of beams, each beam having opposed ends, each opposed end being selectively engageable to a respective post.

9. The hammock and tent assembly of claim 8, further including each opposed end having a line extending therefrom, each line having a first coupler engaged thereto, such that the first coupler is positioned for selectively engaging a second coupler engaged to the respective post, such that each line is removably engaged to the respective post.

10. The hammock and tent assembly of claim 9, wherein the first coupler comprises a carabiner and the second coupler comprises an eyebolt.

11. A hammock and tent assembly comprising:

a frame comprising a plurality of segments, the segments being hingedly interconnected such that the frame is selectively positionable in a deployed configuration, wherein the frame is substantially cuboid shaped and defines an interior space, and a stowed configuration, wherein the segments are proximally positioned;

a hammock selectively engageable to the frame such that the hammock is suspended therefrom and positioned in the interior space;

a shell selectively positionable over and around the frame, wherein the shell is configured for sheltering a user positioned on the hammock, at least a portion of the shell positioned over the top being substantially transparent, wherein the portion is configured for allowing the user a view therethrough;

wherein the plurality of segments comprises a set of posts, a pair of end rails, each end rail being hingedly engaged to and extending between adjacently positioned posts, such that the end rails are opposingly positioned across a top of the frame, and a pair of side rails, each side rail being hingedly engaged to and extending between adjacently positioned posts, such that the side rails are opposingly positioned across the top of the frame; and a shelf panel engaged to and extending between the side rails proximate to a respective end rail, the shelf panel comprising fabric or elastomer, such that the shelf panel is flexible, such that the shelf panel is positioned for folding as the frame is motivated into the stowed configuration, and such that the shelf panel extends substantially planarly between the side rails with the frame in the deployed configuration, wherein the shelf panel is configured for positioning an article.

12. A hammock and tent assembly comprising:

a frame comprising a plurality of segments, the segments being hingedly interconnected such that the frame is selectively positionable in a deployed configuration, wherein the frame is substantially cuboid shaped and defines an interior space, and a stowed configuration, wherein the segments are proximally positioned, the plurality of segments comprising:

a set of posts, each post comprising two segments, a pair of end rails, each end rail being hingedly engaged to and extending between adjacently positioned posts, such that the end rails are opposingly positioned across a top of the frame, each end rail comprising two segments, and a pair of side rails, each side rail being hingedly engaged to and extending between adjacently positioned posts, such that the side rails are opposingly positioned across the top of the frame, each side rail comprising two segments, a pair of crossbeams, each crossbeam being positioned below a respective end rail and being engaged to and extending between adjacently positioned posts proximate to a bottom of the frame, each crossbeam comprising two segments, the segments being rotationally engaged proximate to midpoints thereof, each segment having a lower end hingedly engaged to a respective one of the adjacently positioned posts, each segment having an upper end selectively engageable to the other of the adjacently positioned posts, such that each crossbeam is X-shaped and positioned for stabilizing the adjacently positioned posts substantially in parallel, the upper end of each segment having a first fastener engaged thereto, such that the first fastener is positioned for selectively engaging a second fastener engaged to the other of the adjacently positioned posts, such that each segment is removably engaged to the other of the adjacently positioned posts, the first fastener and the second fastener comprising a latch closure;

a hammock selectively engageable to the frame such that the hammock is suspended therefrom and positioned in the interior space, the hammock comprising a sling panel engaged to and extending between a pair of beams, each beam having opposed ends, each opposed end being selectively engageable to a respective post, each opposed end having a line extending therefrom, each line having a first coupler engaged thereto, such that the first coupler is positioned for selectively engaging a second coupler engaged to the respective post, such that each line is removably engaged to the respective post;

a shell selectively positionable over and around the frame, wherein the shell is configured for sheltering a user positioned on the hammock, at least a portion of the shell positioned over the top being substantially transparent, wherein the portion is configured for allowing the user a view therethrough, the shell having a slit positioned in a wall thereof, wherein the slit is configured for entry of the user into the interior space;

a plurality of rods, each rod being hingedly engaged by a first endpoint to the top of the frame and extending therefrom, each rod having a second endpoint hingedly engaged to a hub, such that the hub is hingedly engaged to each rod of the set of rods, the rods being resiliently flexible, such that the set of rods is selectively positionable in a deployed position, wherein the rods extend upwardly from the top of the frame, such that the shell is domed, and a stowed position corresponding to the stowed configuration of the frame; and a shelf panel engaged to and extending between the side rails proximate to a respective end rail, the shelf panel comprising fabric or elastomer, such that the shelf panel is flexible, such that the shelf panel is positioned for folding as the frame is motivated into the stowed configuration, and such that the shelf panel extends substantially planarly between the side rails with the frame in the deployed configuration, wherein the shelf panel is configured for positioning an article.

* * * * *